United States Patent [19]

Papay et al.

[11] Patent Number: 4,857,214

[45] Date of Patent: Aug. 15, 1989

[54] OIL-SOLUBLE PHOSPHORUS ANTIWEAR ADDITIVES FOR LUBRICANTS

[75] Inventors: Andrew G. Papay, Manchester; Rolfe J. Hartley, Lemay, both of Mo.

[73] Assignee: Ethylk Petroleum Additives, Inc., St. Louis, Mo.

[21] Appl. No.: 245,405

[22] Filed: Sep. 16, 1988

[51] Int. Cl.[4] ..... C10M 133/44; C10M 137/02

[52] U.S. Cl. ..... 252/32.5; 252/49.6; 252/49.9; 252/51.5 A; 252/400.21; 252/400.4; 548/405; 548/412; 548/543; 548/545

[58] Field of Search ..... 252/32.5, 49.6, 49.9, 252/51.5 A, 400.21, 400.22, 400.4; 548/405, 412, 413, 543, 545

[56] References Cited

U.S. PATENT DOCUMENTS

| | | | |
|---|---|---|---|
| 3,235,497 | 2/1966 | Lee | 252/46.7 |
| 3,265,618 | 8/1966 | Henderson et al. | 252/32.5 |
| 3,324,032 | 6/1967 | O'Halloran | 252/46.6 |
| 3,502,677 | 3/1970 | Le Suer | 260/268 |
| 3,511,780 | 5/1970 | Neblett et al. | 252/32.7 |
| 3,513,093 | 5/1970 | Le Suer et al. | 252/32.5 |
| 3,623,985 | 11/1971 | Hendrickson | 252/51.5 |
| 3,945,933 | 3/1976 | Chibnik et al. | 252/33.3 |
| 3,950,341 | 4/1976 | Okamoto et al. | 260/268 C |
| 3,991,056 | 11/1976 | Okamoto et al. | 260/268 C |
| 4,016,092 | 4/1977 | Andress, Jr. | 252/32.5 |
| 4,093,614 | 6/1978 | Chibnik et al. | 260/299 |
| 4,097,389 | 6/1978 | Andress, Jr. | 252/51.5 A |
| 4,338,205 | 7/1982 | Wisotsky | 252/32.5 |
| 4,428,849 | 1/1984 | Wisotsky | 252/33.4 |
| 4,554,086 | 11/1985 | Karol et al. | 252/49.6 |
| 4,615,826 | 10/1986 | Erdman | 252/32.5 |
| 4,634,543 | 1/1987 | Okada et al. | 252/78.5 |
| 4,648,980 | 3/1987 | Erdman | 252/32.5 |
| 4,747,971 | 5/1988 | Erdman | 252/32.5 |

*Primary Examiner*—Jacqueline V. Howard

*Attorney, Agent, or Firm*—David M. Bunnell; John F. Sieberth

[57] ABSTRACT

Oil-soluble reaction products of inorganic phosphorus containing acids or anhydrides with a boron compound and ashless dispersants such as alkenyl succinimides are useful as antiwear/EP additives in lubricants.

35 Claims, No Drawings

OIL-SOLUBLE PHOSPHORUS ANTIWEAR ADDITIVES FOR LUBRICANTS

BACKGROUND OF THE INVENTION

This invention relates generally to phosphorus containing compounds useful as additives in lubricants and more specifically to reaction products of inorganic phosphorus containing acids or anhydrides, including partial and total sulfur analogs thereof, a boron compound and ashless dispersants. The products are oil-soluble and impart antiwear and extreme pressure (EP) properties and antioxidancy to lubricating oils including functional fluids.

Nitrogen and phosphorus containing succinic acid derivatives are disclosed in U.S. Pat. No. 3,502,677 for use in lubricants, fuels and power transmitting fluids to provide antiwear properties in addition to dispersancy. We have now prepared antiwear compositions of inorganic phosphorus containing acids and ashless dispersants in oil-soluble form which provide improved oxidation performance as well as protection for rubber seals.

BRIEF SUMMARY OF THE INVENTION

In accordance with this invention, there is provided an oil-soluble reaction product of an inorganic phosphorus acid or anhydride, including partial and total sulfur analogs thereof, a boron compound and an ashless dispersant which contains basic nitrogen and/or a free hydroxyl group. The ashless dispersants can be selected from hydrocarbyl succinimides, hydrocarbyl succinamides, mixed ester/amides of hydrocarbyl-substituted succinic acid, hydroxyesters of hydrocarbyl-substituted succinic acid, and Mannich condensation products of hydrocarbyl-substituted phenols, formaldehyde and polyamines. Mixtures of such dispersants can also be used.

DETAILED DESCRIPTION

Examples of inorganic phosphorus acids and anhydrides which are useful in forming the products of the invention include phosphorous acid, phosphoric acid, hypophosphoric acid, phosphorous trioxide ($P_2O_3$), phosphorous tetraoxide ($P_2O_4$), and phosphoric anhydride ($P_2O_5$). Partial or total sulfur analogs such as phosphorotetrathioic acid ($H_3PS_4$), phosphoromonothioic acid ($H_3PO_3S$), phosphorodithioic acid ($H_3PO_2S_2$) and phosphorotrithioic acid ($H_3POS_3$), and $P_2S_5$ can also be used. Preferred is phosphorous acid ($H_3PO_3$).

The inorganic, oil-insoluble phosphorus containing acids are reacted with a boron compound and an ashless dispersant which contains basic nitrogen or one or more free hydroxyl groups. The resulting product is oil-soluble. The ashless dispersants are well known lubricating oil additives. They include the hydrocarbyl-substituted succinamides and succinimides of polyethylene polyamines such as tetraethylene-pentamine which are more fully described, for example, in U.S. Pat. Nos. 3,172,892; 3,219,666 and 3,361,673 whose disclosures are incorporated herein by reference. Other examples of suitable ashless dispersants include (i) mixed ester/amides of hydrocarbyl-substituted succinic acid made using alkanols, amines, and/or aminoalkanols, (ii) hydrocarbyl-substituted succinic acid hydroxyesters containing at least one free hydroxyl group made using polyhydroxy alcohols such as are disclosed in U.S. Pat. No. 3,381,022 whose disclosure is incorporated herein by reference and (iii) the Mannich dispersants which are condensation products of hydrocarbyl-substituted phenols, formaldehyde and polyethylene polyamines such as are described, for example, in U.S. Pat. Nos. 3,368,972; 3,413,374; 3,539,633; 3,649,279; 3,798,247 and 3,803,039 whose disclosures are incorporated herein by reference. The hydrocarbyl substituent is usually a polyolefin and preferably a polyisobutylene group having a number average molecular weight of from about 800 to 5,000. The ashless dispersant is preferably an alkenyl succinimide such as is commercially available from Ethyl Corporation under the trademark HiTEC® 644.

Suitable compounds of boron include, for example, boron acids such as boric acid, boronic acid, tetraboric acid, metaboric acid, esters of such acids, such as mono- di- and tri-organic esters with alcohols having 1 to 20 carbon atoms e.g. methanol, ethanol, isopropanols, butanols, pentanols, hexanols, ethylene glycol, propylene glycol and the like, and boron oxides such as boron oxide and boron oxide hydrate.

Optionally, additional sources of basic nitrogen can be included in the phosphorus acid-ashless dispersant-boron mixture so as to provide a molar amount (atomic proportion) of basic nitrogen up to that equal to the molar amount of basic nitrogen contributed by the ashless dispersant. Preferred auxiliary nitrogen compounds are long chain primary, secondary and tertiary alkyl amines containing from about 12 to 24 carbon atoms, including their hydroxyalkyl and aminoalkyl derivatives. The long chain alkyl group may optionally contain one or more ether groups. Examples of suitable compounds are oleyl amine, N-oleyltrimethylene diamine, N-tallow diethanolamine, N,N-dimethyl oleylamine and myristyloxapropyl amine.

Other materials normally used in lubricant additives which do not interfere with the reaction may also be added, for example, a benzotriazole, including lower ($C_1$–$C_4$) alkyl-substituted benzotriazoles, which function to protect copper surfaces.

The reaction can be carried out in the absence of solvent by mixing and heating the reactants at temperatures of about 40°–150° C. (preferred about 100° C.) for about 1 to 3 hours with agitation until a clear, oil-soluble solution is obtained. Preferably, water is added to facilitate the initial dissolution of the boron compound. Water formed in the reaction and any added water is then removed by vacuum distillation at temperatures of from about 100°–140° C. Preferably, the reaction is carried out in a diluent oil or a solvent such as a mixture of aromatic hydrocarbons.

The amount of phosphorus compound employed ranges from about 0.001 mole to 0.999 mole per mole of basic nitrogen and free hydroxyl in the reaction mixture up one half of which may be contributed by an auxiliary nitrogen compound. The amount of boron compound employed ranges from about 0.001 mole to about 1 mole per mole of basic nitrogen and/or hydroxyl in the mixture which is in excess of the molar amount of inorganic phosphorus compound.

The amount of added water is not particularly critical as it is removed by distillation at the end of the reaction. Amounts up to about one percent by weight of the mixture are preferred. When used, the amount of diluent generally ranges from about 10 to about 50 percent by weight of the mixture. When added, the amount of copper protectant generally ranges from about 0.5 to 5 percent by weight of the mixture.

Generally, the following amounts of ingredients in relative proportions by weight are used in the reaction:

| | |
|---|---|
| Dispersant | 0.2 to 10 parts |
| Phosphorus Acid | 0.01 to 2 parts |
| $H_2O$ | 0 to 2 parts |
| Diluent Oil or Solvent | 0 to 10 parts |
| Boric Acid | 0.01 to 2 parts |
| Auxiliary Nitrogen Compound | 0 to 5.0 parts |

Preferred amounts are:

| | |
|---|---|
| Dispersant | 1 to 5 parts |
| Phosphorus Acid | 0.01 to 0.5 part |
| Water | 0.01 to 1 part |
| Diluent | 0.5 to 3 parts |
| Boric Acid | 0.01 to 0.5 part |
| Auxiliary Nitrogen Compound | 0.001 to 2.0 parts |

The clear product solution can be blended with other ingredients as is known in the art to form either a lubricant additive concentrate or a complete lubricant. Such ingredients include, for example, (1) additional copper corrosion protectants such as thiadiazole derivatives (2) friction modifiers such as sulfurized fatty esters, long chain amides, long chain amines, organic phosphonates, phosphates and phosphates (3) antioxidants such as dialkyl diphenylamines, hindered phenols, such as bis-o-t-butyl phenols and sulfur bridged phenolic derivatives (4) seal swelling agents such as aromatic hydrocarbons and aromatic sulfones (5) defoamants such as polydimethyl silicones and/or polyethyl-octyl acrylates (6) viscosity index improvers such as polymethacrylate, and (7) diluent oils.

The ashless dispersant usually comprises up to about 98% by weight and preferably 80 to 96% by weight of the active ingredients, excluding the diluent oil, in the additive composition. As known in the art additive concentrates contain a major portion of additive and a minor amount of oil and lubricants contain a major portion of an oil of lubricating viscosity and a minor, effective antiwear and rubber seal protecting amount of additive composition.

The invention is further illustrated by, but is not intended to be limited to, the following examples in which parts are parts by weight unless otherwise indicated.

EXAMPLE 1A

A preblend is made using a commercial succinimide ashless dispersant (HiTECÅ 644 dispersant), 260 parts, an alkylnaphthalene aromatic oil diluent, 100 parts, phosphorous acid, 8 parts, tolutriazole, 3.5 parts, boric acid, 8 parts and water, 3.0 parts. The materials are mixed and heated at 100° C. for 2 hours until all of the solid materials are dissolved. A vacuum of 40 mm is gradually drawn on the product to remove the water formed while the temperature is slowly raised to 110° C. A clear solution is obtained which is soluble in oil.

EXAMPLE 1B

A partial concentrate is prepared from sulfurized fat, 30 parts, styrene-maleic anlydride copolymer pour point depressant, 15 parts, phenolic antioxidant (EthylÅ 728), 20 parts, hydroxyethylated long chain amine, 10 parts, 4% Dow-Corning/antifoam fluid, 6 parts, polymethylmethacrylate viscosity index improver, 340 parts and red dye, 2 parts. The materials are stirred and mixed for 45 minutes at 60°-70° C.

EXAMPLE 1C

A mixture of 378 parts of the preblend of Example 1A is mixed with 447 parts of the partial concentrate of Example 1B together with 9175 parts of Exxon 1365 base oil to prepare a complete blended lubricant.

Comparison 1

A preblend was made using a commercial succinimide ashless dispersant (HiTEC® 644 dispersant), 260 parts, an alkylnaphthalene aromatic oil diluent, 100 parts, boric acid, 8 parts and tolutriazole, 3.5 parts. The materials were mixed and heated at 100 degrees C. for 2 hours until all of the solid materials had dissolved. A vacuum of 40 mm was gradually drawn on the product to remove the water formed while the temperature was slowly raised to 110° C. A mixture of 370 parts of the preblend was mixed with 447 parts of the partial concentrate of Example 1B, and 46 parts of zinc bis-(2-ethylhexyl) phosphorodithioate together with 9137 parts of Exxon 1365 base oil to prepare a complete blended lubricant.

Comparison 2

A mixture of 370 parts of the preblend of Comparison 1 was mixed with 447 parts of the partial concentrate of Example 1B and 37 parts of tricresyl phosphate together with 9146 parts of Exxon 1365 base oil to prepare a complete blended lubricant.

Friction Test

Using the LVFA (low velocity friction apparatus) the coefficient of friction was measured at sliding speeds of 10 and 40 feet per minute using a friction pad of SD1777 material. The same measurement was also made on oil which had been subjected to a HOOT (hot oil oxidation test) test for 16 hours with no catalyst added.

| | COEF. OF FRICTION (× 1000) | | |
|---|---|---|---|
| Lubricant | (A) 10 FT/MIN | (B) 40 FT/MIN | Delta (A-B) |
| Comparison 1 | | | |
| (Fresh) | 132 | 132 | 0 |
| (Hooted) | 164 | 150 | 14 |
| Comparison 2 | | | |
| (Fresh) | 140 | 132 | 8 |
| (Hooted) | 162 | 150 | 12 |
| Example 1C | | | |
| (Fresh) | 130 | 130 | 0 |
| (Hooted) | 160 | 153 | 7 |

These results show that the frictional properties of blends using phosphorous acid are just as good as those of the other phosphorus sources and superior in retaining those properties after oxidation.

Hoot Test

The lubricants prepared in Example 1C, the two comparisons, and a control with no phosphorus were subjected to 64 hour HOOT tests. In this procedure, 30 ml. of oil is placed in a 1×6 in. test tube containing a 7 mm. OD. tube 8 inches (203 mm) in length. As a catalyst, 1.0 ml of a 3.3% solution of ferric acetylacetonate is added along with a small drop of Dow-Corning antifoam solution. After 64 hours in a bath at 161° C. with an airflow of 10 L/hr. passing through the oil, the absorbance of the oil at a peak in the 1720 reciprocal centimeter region of the infra-red spectrum is measured. The difference from that of the fresh oil is taken as a measure of the susceptibility to oxidation.

OXIDATION THERMAL STABILITY 64 HOUR HOOT

| Lubricant | Phosphorus Source | % By Wt. | Blotter Spot | IR |
|---|---|---|---|---|
| Comparison | Zinc dialkyl-dithiophosphate | 0.46 | Black Tar | >1.0 |
| Comparison 2 | Tricresyl-phosphate | 0.37 | Black Tar | >1.0 |
| Example 1C | Phosphorous acid | 0.08 | Light Brown | 0.2, 0.13 |
| Control | None | — | Black Tar | >1.0 |

The results show that the phosphorous acid based additive is much superior in oxidation resistance to additives containing the other two phosphorus sources.

4-Ball Test The lubricants prepared in Example 1C, the two comparison compositions and a control with containing no phosphorous additive were tested in the 4-Ball Wear Test. In this procedure, 10 ml. of oil is placed on the 4 steel balls arranged in a pyramidal configuration in a steel cup with the 3 lower balls held fast and the top one rotating against them. The test was run for two hours under a 40 Kg. load at 1200 Rpm and at 150° F. (65° C.). At the end of the test the average wear scar diameter on the three lower balls was measured.

FOUR BALL WEAR TEST EVALUATION

| Lubricant | Phosphorus Source | % By Wt. | P % | Scar Diameter, MM |
|---|---|---|---|---|
| Comparison 1 | Zinc dialkyl-dithiophosphate | 0.46 | 0.03 | 0.400 |
| Comparison 2 | Tricresyl-phosphate | 0.37 | 0.03 | 0.475 |
| Example 1C | Phosphorous acid | 0.08 | 0.03 | 0.400 |
| Control | None | — | — | 0.525 |

The results show that the phosphorous acid product is superior in wear resistance to the additive containing tricresyl phosphate and equal to that of the additive containing zinc dithiophosphate.

Copper Corrosion Test

The lubricants were tested in the D-130 test at 150° C. for three hours. This test indicates the resistance of the lubricant to corrosion of copper. A freshly refinished copper strip is placed in a 1×6 in. (25.4×152.4 mm.)test tube with 30 ml. of the oil being tested. The tube is placed in a heated bath for the proper period of time. After removal from the bath the condition of the strip is compared with a set of standard strips and given a rating according to the standard strip most closely matched. The ratings ranged from 1 to 4 with letters A to D for intermediate ranges.

| Lubricant | D-130 Rating |
|---|---|
| Comparison 1 | IB-2C |
| Comparison 2 | IB |
| Example 1C | IB |

The results show that the phosphorous acid blend provided excellent control of copper corrosion.

A power steering pump wear evaluation was conducted with lubricants containing zinc dialkyl dithiophosphate, tricresylphosphate and a control in comparison to the lubricant of Example 1C with the following results.

POWER STEERING PUMP WEAR EVALUATION OF AUTOMATIC TRANSMISSION FLUIDS

| Lubricant | Phosphorus Source | % By Wt. | P % | Rating |
|---|---|---|---|---|
| Comparison 1 | Zinc dialkyldithio-phosphate | 0.46 | 0.03 | 2.5 (Fair to Good) |
| Comparison 2 | Tricresylphosphate | 0.37 | 0.03 | 3.8 (Borderline) |
| Example 1C | Phosphorous acid | 0.08 | 0.03 | 1.0 (Excellent) |
| Control | No phosphorus | 0 | 0 | 5.0 (Bad Failure) |

Comparision 3

Example 1 was repeated except that no boric acid was added to the mixture in Example 1A and 9183 parts of oil were used in Example 1C.

Mercon® ATRR 300 Silicone Elastomer Test

Two strips of red silicon rubber cut per ASTM D471 are immersed in a tube containing the test oil. The tube is placed in an oven at 163° C. for 240 hours (10 days). The silicone rubber should show no reversion (as determined by the smear test). The smear test consists of sliding the aged reference sample across a section of white cardboard under approximately 1.8 Kg thumb force. The color smear can be no greater than that produced by sliding an unaged coupon across an identical piece of white cardboard under the same 1.8 Kg thumb force.

SILICON SEAL EVALUATION (MERCON ®)

| Lubricant | Boron Weight | Phosphorus Source | Weight % | Phos-phorus % | Rubber Smear |
|---|---|---|---|---|---|
| Example 1 | 0.014 | Phosphorous Acid | 0.08 | 0.03 | None (Pass) |
| Comparison 3 | None | Phosphorous Acid | 0.08 | 0.03 | Medium (Fail) |

The lubricant additive of the invention thus provides protection against attack of silicon rubber seals compared to an additive prepared without the boron compound.

EXAMPLE 2

A preblend was made using an ashless dispersant made from 2,100 molecular weight polybutene, 260 parts, an aromatic oil diluent, 100 parts, phosphorous acid, 8 parts, boric acid, 8 parts tolyltriazole, 3.5 parts and water, 3 parts. The materials were mixed and heated at 100° C. for 2 hours until all solids were dissolved. A vacuum of 40 mm was drawn on the product to remove the water formed while the temperature was slowly raised to 110° C. A clear solution was obtained which was soluble in oil.

EXAMPLE 3

A preblend was made using a commercial ashless dispersant of the Mannich reaction product type, (Amoco 9250 dispersant), 260 parts, an aromatic oil diluent, 100 parts, phosphorous acid, 8 parts, boric acid, 8 parts, tolyltriazole, 3.5 parts and water, 3 parts. The materials were mixed and heated at 100° C. for 2 hours until all solids were dissolved. A vacuum of 40 mm was drawn on the product to remove the water formed while the temperature was slowly raised to 110° C. A clear solution was obtained which was soluble in oil.

EXAMPLE 4

A preblend was made using a commercial ashless dispersant of the pentaerythritol ester type (Lubrizol 936 dispersant), 260 parts, an aromatic oil diluent, 100 parts, phosphorous acid, 8 parts, boric acid, 8 parts, tolyltriazole, 3.5 parts and water, 3 parts. The materials were mixed and heated at 100° C. for 2 hours until all solids were dissolved. A vacuum of 40 mm was drawn on the product to remove the water formed while the temperature was slowly raised to 110° C. A clear solution was obtained which was soluble in oil.

EXAMPLE 5

A mixture of 260 parts of a commercial ashless dispersant (succinimide) made from 900 molecular weight polybutene and 8 parts of phosphorus acid was heated to 100° C. for 2 hours until the solids were dissolved. A clear solution was obtained which was soluble in oil.

EXAMPLE 6

A mixture of 260 parts of a succinimide ashless dispersant made from 2100 molecular weight polybutene and 8 parts of phosphorus acid was heated to 100° C. for 2 hours until the solids were dissolved. A clear solution was obtained which was soluble in oil.

EXAMPLE 7

A mixture of 260 parts of a commercial ashless dispersant of the Mannich reaction product type (Amoco® 9250) and 8 parts of phosphorus acid was heated to 100° C. for 2 hours until the solids were dissolved. A clear solution was obtained which was soluble in oil.

EXAMPLE 8

A mixture of 260 parts of a commercial ashless dispersant of the pentaerythritol type (Lubrizol® 936) and 8 parts of phosphorous acid were heated to 100° C. for 2 hours until the solids were dissolved. A clear solution was obtained which was soluble in oil.

Oil blends were made using about 2.6 weight percent of the preblends of Examples 5, 6, 7 and 8 in 100 neutral base oil and four ball evaluations were conducted in comparison to blends of ashless dispersants in neutral base oil. The results are listed below:

FOUR BALL WEAR TEST EVALUATION

| Oil Blends at 2.6% wt in 100 Neutral Base | Phosphorus Source | P % | Scar Diam. MM |
|---|---|---|---|
| Example 5 | Phosphorous acid | 0.03 | 0.575 |
| Example 6 | Phosphorous acid | 0.03 | 0.625 |
| Example 7 | Phosphorous acid | 0.03 | 0.550 |
| Example 8 | Phosphorous acid | 0.03 | 0.487 |
| Succinimide dispersant (900 MW) | None | None | 0.987 |

-continued

FOUR BALL WEAR TEST EVALUATION

| Oil Blends at 2.6% wt in 100 Neutral Base | Phosphorus Source | P % | Scar Diam. MM |
|---|---|---|---|
| Succinimide dispersant (2100 MW) | None | None | 0.975 |
| Amoco 9250 Mannich reaction dispersant | None | None | 0.925 |
| Lubrizol 936 pentaerythritol ester dispersant | None | None | 0.975 |

EXAMPLE 9

The process of Example 1 was repeated except that 11 parts of $P_2S_5$ were used in place of the phosphorous acid, the $P_2S5$ was added to the preblend after water distillation and the mixture was then heated for an additional hour at 100° C. to provide a clear, oil-soluble solution. The blended lubricant contains 9172 parts of 100 neutral base oil. The lubricant contained 0.11 percent by weight $P_2O_5$ and 0.03 percent by weight phosphorous. The lubricant gave a 4-Ball scar diameter of 0.450 and a black tar blotter spot with a IR value of 0.8 in the 65 hour HOOT thermal stability test.

EXAMPLE 10

The process of Example 9 was repeated except that the $P_2S_5$ was replaced by 7 parts $P_2O_5$. A clear oil-soluble product was produced and the complete blended lubricant contained 9176 of neutral base oil, 0.07 percent by weight $P_2O_5$ and 0.03 percent by weight phosphorous. The lubricant gave a 4-Ball scar diameter of 0.450, a black oil blotter spot with an IR value of 0.5 in the 65 hour HOOT Thermal stability test, and a 2.0 (good) power steering pump wear test rating. The lubricant passed the silicon seal test (no smear).

FZG LOAD (EP) TEST

| | Phosphorous Source | Wt. % | P % | Pass, Stages |
|---|---|---|---|---|
| Control | None | — | — | 8 |
| Comparison 2 | Tricresyl phosphate | 0.37 | 0.03 | 8 |
| Comparison 1 | Zinc dialkyldithiophosphate | 0.46 | 0.03 | 10 |
| Example 1C | Phosphorous acid | 0.08 | 0.03 | 10 |

FZG WEAR TEST - LOW SPEED (10 stages, 100 RPM, 20 hours)

| | Phosphorous Source | Wt. % | P % | WEAR, MG |
|---|---|---|---|---|
| Comparison 1 | Zinc dialkyldithiophosphate | 0.46 | 0.03 | 26 |
| Comparison 2 | Tricresyl phosphate | 0.37 | 0.03 | 41 |
| Example 1C | Phosphorous acid | 0.08 | 0.03 | 21 |

FZG test apparatus and procedure is fully described in the DIN 51354 (Germany) IP 334 (U.K.) and CEC L-07-A-75 (common market) official standards. The lubricant of Example 1C gave improved FZG wear test results compared to those containing zinc dialkyldithiophosphate (ZDDP) and tricresyl phosphate. The lubricant was equal to ZDDP and better than tricresyl phosphate in the FZG load test.

As illustrated by the foregoing comparative test data, the oil-soluble additives of the invention, which are formed using inorganic phosphorous acids and anhydrides, provide lubricants with improved anti-wear and rubber seal protective properties. A further commercial advantage is provided because the inorganic phosphorous acids and anhydrides are less expensive than the organic phosphates and phosphites.

We claim:

1. An oil-soluble lubricant additive composition comprising the reaction product of an inorganic phosphorus acid or anhydride, including partial and total sulfur analogs thereof, a boron compound, and an ashless dispersant which contains basic nitrogen and/or a hydroxyl group.

2. The composition of claim 1 wherein the ashless dispersant is selected from hydrocarbyl succinimides, hydrocarbyl succinamides, mixed ester/amides of hydrocarbyl-substituted succinic acid, hydroxyesters of hydrocarbyl-substituted succinic acid, Mannich condensation products of hydrocarbyl-substituted phenols, formaldehyde and polyamines, and mixtures thereof.

3. The composition of claim 1 wherein the amount of phosphorus acid or anhydride is from about 0.001 mole to 0.999 mole per mole of basic nitrogen and hydroxyl in the composition and the amount of boron compound is from about 0.001 mole to 1 mole per mole of basic nitrogen and hydroxyl in the mixture which is in excess of the molar amount of phosphorus acid.

4. The composition of claim 2 wherein the ashless dispersant is a hydrocarbyl succinimide.

5. The composition of claim 4 wherein the ashless dispersant is a polyisobutenyl succinimide in which the polyisobutenyl group has a number average molecular weight of from about 800 to 5,000.

6. The composition of claim 5 wherein the acid is phosphorous acid and the boron compound is boric acid.

7. The composition of claim 1 wherein the acid is phosphorous acid and the boron compound is boric acid.

8. The composition of claim 1 which is formed in the presence of a benzotriazole.

9. The composition of claim 1 which is formed in the presence of a $C_{12}$ to $C_{24}$ alkyl amine so as to provide a molar amount of basic nitrogen up to that equal to the molar amount of basic nitrogen contributed by the ashless dispersant.

10. The composition of claim 1 which is formed in the presence of from about 0.01 to about 1 percent by weight of water in the mixture.

11. An oil-soluble lubricant additive concentrate comprising a major portion of the reaction product of an inorganic phosphorus acid or anhydride, including partial and total sulfur analogs thereof, a boron compound, and an ashless dispersant which contains basic nitrogen and/or a hydroxyl group and a minor portion of a diluent oil.

12. The concentrate of claim 11 wherein the ashless dispersant is selected from hydrocarbyl succinimides, hydrocarbyl succinamides, mixed ester/amides of hydrocarbyl-substituted succinic acid, hydroxyesters of hydrocarbyl-substituted succinic acid, Mannich condensation products of hydrocarbyl-substituted phenols, formaldehyde and polyamines, and mixtures thereof.

13. The concentrate of claim 11 wherein the amount of phosphorus acid or anhydride is from about 0.001 mole to 0.999 mole per mole of basic nitrogen and hydroxyl in the composition and the amount of boron compound is from about 0.001 mole to about 1 mole per mole of basic nitrogen and hydroxyl in the mixture which is in excess of the molar amount of phosphorus acid.

14. The concentrate of claim 12 wherein the ashless dispersant is a hydrocarbyl succinimide.

15. The concentrate of claim 14 wherein the ashless dispersant is polyisobutenyl succinimide in which the polyisobutenyl group has a number average molecular weight of from about 800 to 5,000.

16. The concentrate of claim 15 wherein the acid is phosphorous acid and the boron compound is boric acid.

17. The concentrate of claim 11 wherein the acid is phosphorous acid and the boron compound is boric acid.

18. The concentrate of claim 11 which contains a benzotriazole.

19. A lubricating oil composition comprising a major portion of an oil of lubricating viscosity and a minor portion of an oil soluble lubricant additive composition comprising the reaction product of an inorganic phosphorus acid or anhydride, including partial and total sulfur analogs thereof, a boron compound, and an ashless dispersant which contains basic nitrogen and/or a hydroxyl group.

20. The composition of claim 19 wherein the ashless dispersant is selected from hydrocarbyl succinimides, hydrocarbyl succinamides, mixed ester/amides of hydrocarbyl-substituted succinic acid, hydroxyesters of hydrocarbyl-substituted succinic acid, Mannich condensation products of hydrocarbyl-substituted phenols, formaldehyde and polyamines, and mixtures thereof.

21. The composition of claim 19 wherein the amount of phosphorus acid or anhydride is from about 0.001 mole to 0.999 mole per mole of basic nitrogen and hydroxyl in the composition and the amount of boron compound is from about 0.001 mole to about 1 mole per mole of basic nitrogen and hydroxyl in the mixture which is in excess of the molar amount of phosphorus acid.

22. The composition of claim 20 wherein the ashless dispersant is a hydrocarbyl succinimide.

23. The composition of claim 22 wherein the ashless dispersant is a polyisobutenyl succinimide in which the polyisobutenyl group has a number average molecular weight of from about 800 to 5,000.

24. The composition of claim 23 wherein the acid is phosphorous acid and the boron compound is boric acid.

25. The composition of claim 19 wherein the acid is phosphorous acid and the boron compound is boric acid.

26. The composition of claim 9 which contains a benzotriazole.

27. A process for preparing an oil-soluble lubricant additive from an inorganic phosphorus acid or anhydride, including partial and total sulfur analogs thereof comprising heating a mixture of said acid or anhydride with a boron compound and an ashless dispersant which contains basic nitrogen and/or a hydroxyl group until a clear, oil-soluble solution is obtained.

28. The process of claim 27 wherein the mixture is heated at a temperature of from about 40°–150° C. for about 1 to 3 hours.

29. The process of claim 28 wherein the ashless dispersant is selected from hydrocarbyl succinimides, hydrocarbyl succinamides, mixed ester/amides of hydrocarbyl-substituted succinic acid, hydroxyesters of hydrocarbyl-substituted succinic acid, Mannich condensation products of hydrocarbyl-substituted phenols, formaldehyde and polyamines, and mixtures thereof.

30. The process of claim 29 wherein the amount of phosphorus acid or anhydride is from about 0.001 mole to 0.999 mole per mole of basic nitrogen and hydroxyl in the composition and the amount of boron compound is from about 0.001 mole to about 1 mole per mole of basic nitrogen and hydroxyl in the mixture which is in excess of the molar amount of phosphorus acid.

31. The process of claim 30 wherein the ashless dispersant is a hydrocarbyl succinimide.

32. The process of claim 31 wherein the ashless dispersant is a polyisobutenyl succinimide in which the polyisobutenyl group has a number average molecular weight of from about 800 to 5,000.

33. The process of claim 31 wherein the acid is phosphorous acid, the boron compound is boric acid and water is added to the mixture.

34. The process of claim 27 which is carried out in the presence of a benzotriazole.

35. The process of claim 27 which is carried out in the presence of a $C_{12}$ to $C_{24}$ alkyl amine so as to provide a molar amount of basic nitrogen up to that equal to the molar amount of basic nitrogen contributed by the ashless dispersant.

* * * * *

UNITED STATES PATENT AND TRADEMARK OFFICE

CERTIFICATE OF CORRECTION

PATENT NO. : 4,857,214

DATED : Aug. 15, 1989

INVENTOR(S) : Andrew G. Papay et al.

It is certified that error appears in the above-identified patent and that said Letters Patent is hereby corrected as shown below:

On the title page:

Assignee reads "Ethylk" and should read -- Ethyl --.

Column 3, line 52 reads "HiTECA" and should read -- HiTEC® --.

Column 3, line 64 reads "anlydride" and should read -- anhydride --.

Column 3, line 65 reads "EthylA" and should read -- Ethyl® --.

Column 7, line 29 reads "phosphorus" and should read -- phosphorous --.

Column 7, line 36 reads "phosphorus" and should read -- phosphorous --.

Column 7, line 43 reads "phosphorus" and should read -- phosphorous --.

Column 8, line 18 reads "$P_2S5$" and should read -- $P_2S_5$ --.

Column 8, line 23/24 reads "phosphorous" and should read -- phosphorus --.

Column 8, line 32 reads "9176" and should read -- 9176 parts --.

Column 8, line 41 reads "Phosphorous" and should read -- Phosphorus --.

UNITED STATES PATENT AND TRADEMARK OFFICE

CERTIFICATE OF CORRECTION

PATENT NO. : 4,857,214

DATED : Aug. 15, 1989

INVENTOR(S) : Andrew G. Papay et al.

It is certified that error appears in the above-identified patent and that said Letters Patent is hereby corrected as shown below:

Column 8, line 52 reads "Phosphorous" and should read -- Phosphorus --.

Column 9, line 3 reads "phosphorous" and should read -- phosphorus --.

Column 9, line 6/7 reads "phosphorous" and should read -- phosphorus --.

Column 10, line 55 reads "9" and should read -- 19 --.

Signed and Sealed this

Thirteenth Day of August, 1991

*Attest:*

HARRY F. MANBECK, JR.

*Attesting Officer*

*Commissioner of Patents and Trademarks*